US011095062B2

(12) United States Patent
Thomas et al.

(10) Patent No.: US 11,095,062 B2
(45) Date of Patent: Aug. 17, 2021

(54) CONNECTOR ASSEMBLY

(71) Applicant: Westinghouse Air Brake Technologies Corporation, Wilmerding, PA (US)

(72) Inventors: Jeffrey Alan Thomas, Erie, PA (US); Richard James Zajkowski, Powell, OH (US); Greg Badders, Wilmerding, PA (US); Neil Bradley, Wilmerding, PA (US); Jacob Pressman, Erie, PA (US)

(73) Assignee: WESTINGHOUSE AIR BRAKE TECHNOLOGIES CORPORATION, Wilmerding, PA (US)

( * ) Notice: Subject to any disclaimer, the term of this patent is extended or adjusted under 35 U.S.C. 154(b) by 0 days.

(21) Appl. No.: 16/722,198

(22) Filed: Dec. 20, 2019

(65) Prior Publication Data

US 2021/0194167 A1 Jun. 24, 2021

(51) Int. Cl.

| | |
|---|---|
| ***H01R 13/24*** | (2006.01) |
| ***H01R 13/20*** | (2006.01) |
| ***H01R 12/55*** | (2011.01) |
| ***H01R 13/6582*** | (2011.01) |
| ***H01R 43/26*** | (2006.01) |
| ***H01R 13/516*** | (2006.01) |
| ***H01R 13/631*** | (2006.01) |
| ***B61G 5/06*** | (2006.01) |
| ***H01R 13/53*** | (2006.01) |

(52) U.S. Cl.

CPC ..... *H01R 13/24* (2013.01); *B61G 5/06* (2013.01); *H01R 12/55* (2013.01); *H01R 13/20* (2013.01); *H01R 13/516* (2013.01); *H01R 13/53* (2013.01); *H01R 13/6315* (2013.01); *H01R 13/6582* (2013.01); *H01R 43/26* (2013.01)

(58) Field of Classification Search

CPC ..... H01R 12/55; H01R 13/20; H01R 13/516; H01R 13/53; H01R 13/6315; H01R 13/6582; H01R 43/26

See application file for complete search history.

(56) References Cited

U.S. PATENT DOCUMENTS

| | | | | |
|---|---|---|---|---|
| 7,575,476 | B2 * | 8/2009 | Tyler | H01R 13/66 439/607.04 |
| 8,715,016 | B2 * | 5/2014 | DeBock | H01R 13/514 439/701 |
| 9,425,541 | B2 * | 8/2016 | Data | H01R 13/6315 |

* cited by examiner

*Primary Examiner* — Briggitte R. Hammond
(74) *Attorney, Agent, or Firm* — Mary D. Lawlor; The Small Patent Law Group LLC

(57) ABSTRACT

A connector assembly includes a system connector having a system housing and a system bracket coupled with the system housing. The system bracket includes plural system power contact receptors that receive plural system power contacts. The plural system power contacts are separate from each other by one or more extensions coupled with the system bracket. A module connector is coupled with the system connector. The module connector includes a module housing and a module bracket coupled with the module housing. The module bracket includes plural module power contact receptors that receive plural module power contacts. Each of the plural module power contacts are separated from each other by one or more extensions coupled with the module bracket. Each of the plural system power contacts of the system bracket are configured to mate with one of the plural module power contacts of the module bracket as plural power contact assemblies.

20 Claims, 10 Drawing Sheets

CONNECTOR ASSEMBLY

BACKGROUND

Technical Field

Embodiments of the subject matter described herein relate to connector assemblies. Other embodiments relate to electrical connector assemblies.

Discussion of Art

The interconnection of a plural electrical circuits, such as those of a battery system, typically requires multiple interfaces to connect the entire battery network into a single entity. Typically, a connector may provide a single function, for example, power only, fiber optic only, or signal only. Moreover, assembling the connector with a system may require a direct line-of-sight of the mating interface to accurately align the connector with the mating system.

Furthermore, the power capability of typical connectors may be limited due to the size of the connector. As one example, in order to electrically couple power cables of increasing electrical power, the connectors may need to increase in size. This can increase the cost to manufacture or take up more space within an assembly.

BRIEF DESCRIPTION

In one or more embodiments, a connector assembly includes a system connector having a system housing and a system bracket coupled with the system housing. The system bracket includes plural system power contact receptors that receive plural system power contacts. The plural system power contacts are separate from each other by one or more extensions coupled with the system bracket. A module connector is coupled with the system connector. The module connector includes a module housing and a module bracket coupled with the module housing. The module bracket includes plural module power contact receptors that receive plural module power contacts. Each of the plural module power contacts are separated from each other by one or more extensions coupled with the module bracket. Each of the plural system power contacts of the system bracket are configured to mate with one of the plural module power contacts of the module bracket as plural power contact assemblies.

In one or more embodiments, a connector assembly includes a system connector having a system housing and a system bracket coupled with the system housing. The system bracket includes plural system power contact receptors that receive plural system power contacts. The plural system power contacts are separate from each other by one or more extensions coupled with the system bracket. The system connector includes one or more system signal contacts disposed within a system signal contact housing. The system signal contact housing is retained within a pocket of the system bracket. A module connector is coupled with the system connector. The module connector includes a module housing and a module bracket coupled with the module housing. The module bracket includes plural module power contact receptors that receive plural module power contacts. Each of the plural module power contacts are separated from each other by one or more extensions coupled with the module bracket. The module connector includes one or more module signal contacts disposed within a module signal contact housing. The module signal contact housing is retained within a signal pocket of the module bracket. Each of the plural system power contacts of the system bracket are configured to mate with one of the plural module power contacts of the module bracket as plural power contact assemblies. Each of the module signal contacts of the module connector are electrically coupled with one of the one or more system signal contacts of the system connector to form plural signal contact assemblies.

In one or more embodiments, a connector assembly includes a system connector having a system housing and a system bracket coupled with the system housing. The system bracket includes plural system power contact receptors that receive plural system power contacts. The plural system power contacts are separate from each other by one or more extensions coupled with the system bracket. The system connector includes one or more system signal contacts disposed within a system signal contact housing. The system signal contact housing is retained within a pocket of the system bracket. A module connector is coupled with the system connector. The module connector includes a module housing and a module bracket coupled with the module housing. The module bracket includes plural module power contact receptors that receive plural module power contacts. Each of the plural module power contacts are separated from each other by one or more extensions coupled with the module bracket. The module connector includes one or more module signal contacts disposed within a module signal contact housing. The module signal contact housing is retained within a signal pocket of the module bracket. Each of the plural system power contacts of the system bracket are configured to mate with one of the plural module power contacts of the module bracket as plural power contact assemblies. Each of the plural power contact assemblies has an operating voltage of at least 2000 volts and a current rating of at least 225 amperes. Each of the module signal contacts of the module connector are electrically coupled with one of the one or more system signal contacts of the system connector to form plural signal contact assemblies. One or more of the plural signal contact assemblies has an operating voltage of at least 75 volts.

BRIEF DESCRIPTION OF THE DRAWINGS

The inventive subject matter may be understood from reading the following description of non-limiting embodiments, with reference to the attached drawings, wherein below.

DETAILED DESCRIPTION

Embodiments of the subject matter described herein relate to connector assemblies having a system connector coupled with a module connector. The connector assembly may interconnect an energy storage module (e.g., one or more battery modules) with a system, such as an energy storage system, a propulsion system, or the like, of a vehicle system or other powered system. The connector assembly also provides capabilities across different spectrums, including power with communication, or other low-voltage wiring, within a common connector assembly. The system connector may include plural system power contacts that may mate with corresponding module power contacts to form power contact assemblies. Different aspects of the connector assembly (e.g., materials, conductivity, sizes, thicknesses, dielectric constraints, spacing, or the like) may be selected with reference to each of the power contact assemblies having a target operating voltage of at least 2000 volts and having a current rating of at least 225 amperes.

Figure 1:
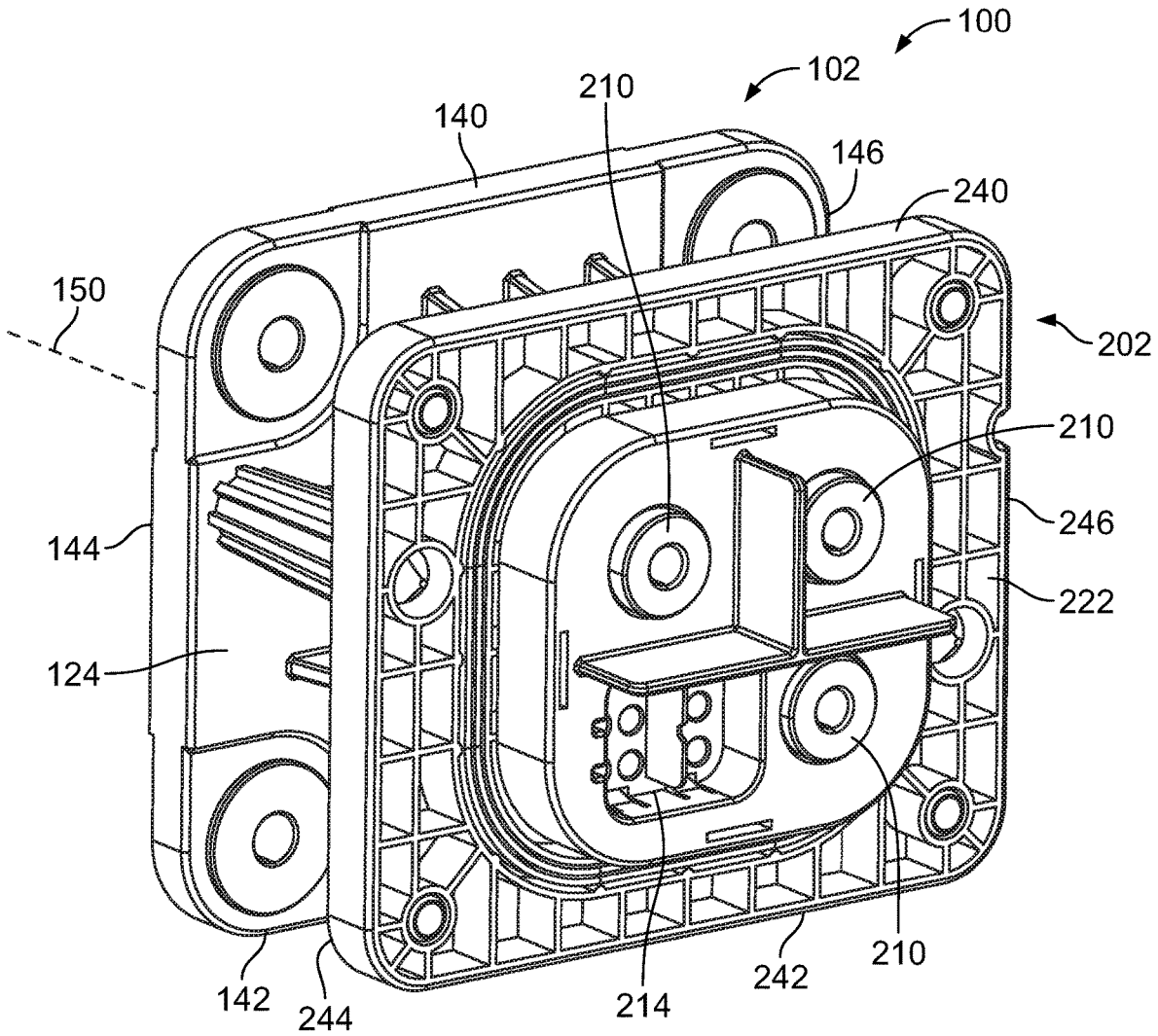
FIG. 1 schematically illustrates a front perspective view of a connector assembly in accordance with one embodiment.
Figure 2:
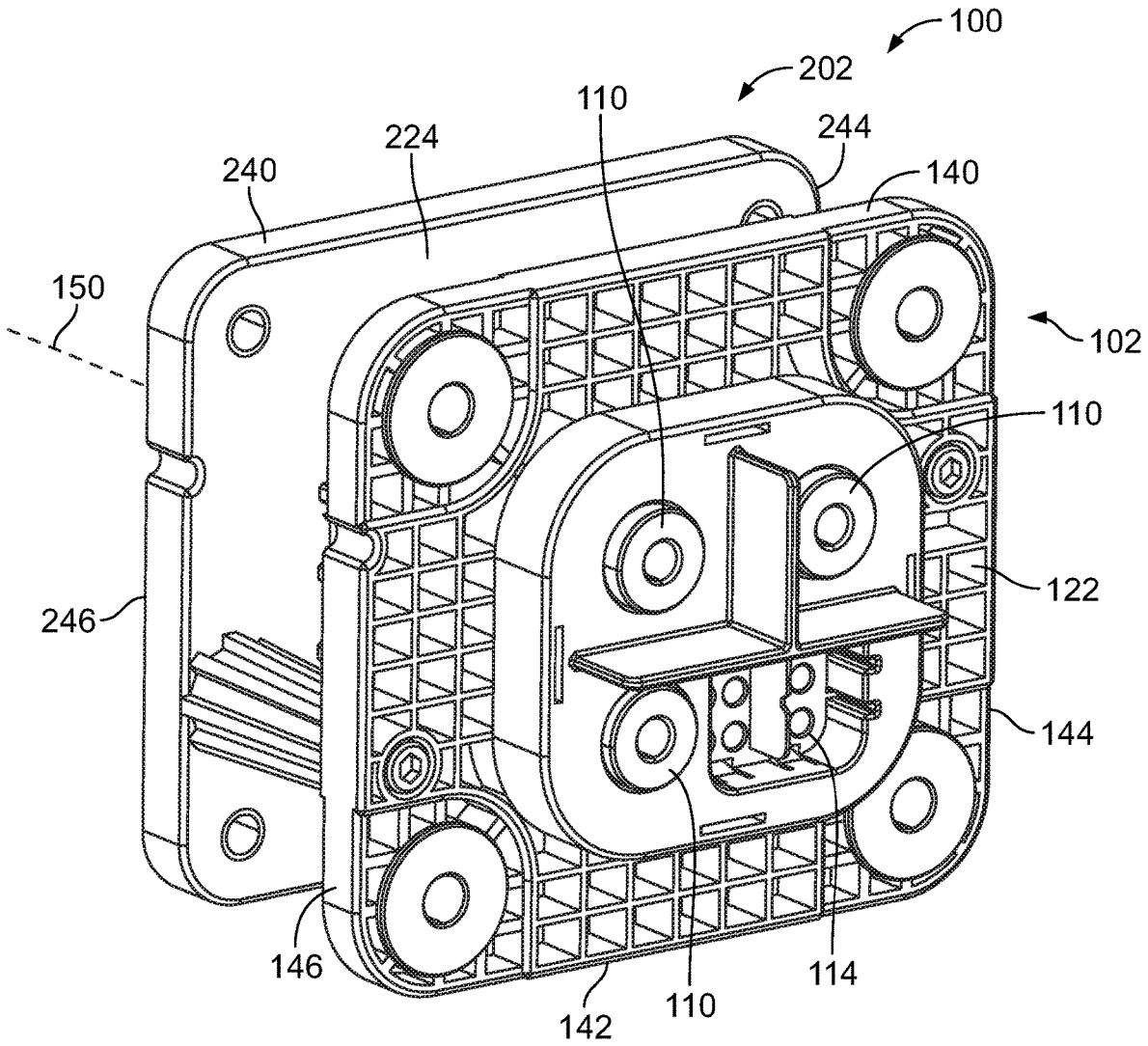
FIG. 2 illustrates a rear perspective view of the connector assembly shown in FIG. 1.
Figure 3:
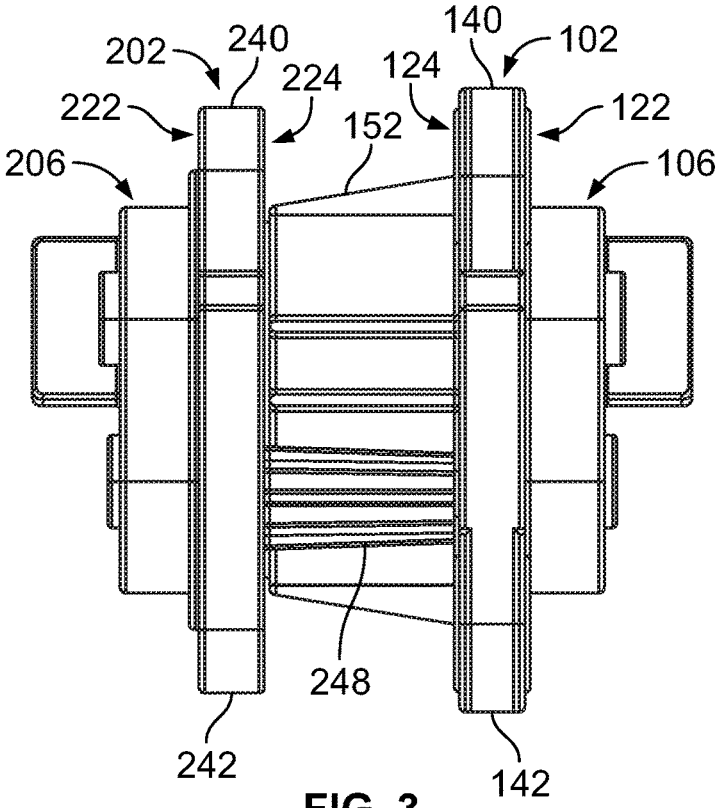
FIG. 3 illustrates a first side view of the connector assembly shown in FIG. 1.
Figure 4:
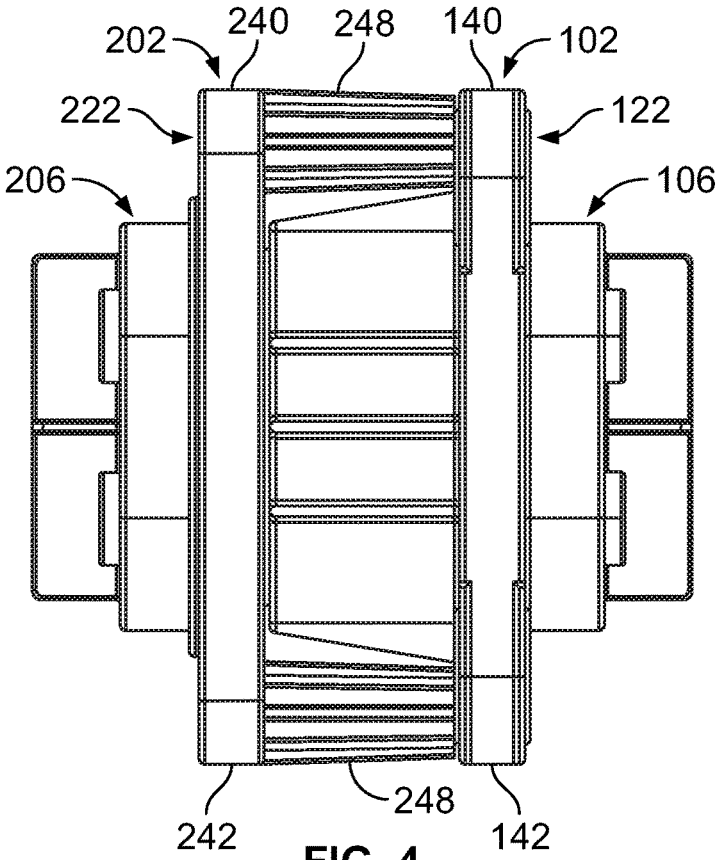
FIG. 4 illustrates a second side view of the connector assembly shown in FIG. 1.

FIG. 1 schematically illustrates a front perspective view of a connector assembly 100 in accordance with one embodiment. FIG. 2 illustrates a rear perspective view of the connector assembly 100, FIG. 3 illustrates a first side view of the connector assembly 100, and FIG. 4 illustrates a second side view of the connector assembly 100. FIGS. 1 through 4 will be described together herein.

The connector assembly may be used within a powered system to interconnect different systems. As one example, the connector assembly may electrically couple an energy storage system, such as a battery module, with a mating system of a vehicle system, such as, but not limited to, plurality of battery modules of a battery system (not shown). As another example, the connector assembly may electrically couple an energy storage device of a vehicle system with another mating system of the vehicle system, such as a propulsion system of the vehicle system. For example, the vehicle system may be a rail vehicle system that includes a chassis with plural wheels, an energy storage device, an energy storage system, and a propulsion system coupled to the chassis. The plural wheels my be driven by the propulsion system to move the rail vehicle along a track. The module connector coupled with the system connector may electrically couple an energy storage device with one or more of the propulsion system or the energy storage system.

As another example, the connector assembly may electrically couple the energy storage device of the vehicle system with an energy storage system of the vehicle system (not shown). In one or more embodiments, the vehicle system may be a rail vehicle system. Optionally, the vehicle system may be other types or models of vehicle systems, such as automobiles, trucks, buses, mining vehicles, marine vessels, aircraft (manned or unmanned, such as drones), agricultural vehicles, or other off-highway vehicles.

The connector assembly 100 includes a system connector 102 and a module connector 202. The system connector is configured to be coupled with the module connector along the mating axis 150. The system connector includes a system side 122 and an opposite mating side 124. The module connector includes a module side 222 and an opposite mating side 224. In the illustrated embodiment, the mating sides of the system and module connectors are configured to be facing towards each other when the system connector mates with the module connector.

In one or more embodiments, the system side of the system connector may be coupled with an energy storage system (e.g., a battery module system including one or more battery modules as one example), a propulsion system, an energy management system, or the like, of the vehicle system. Additionally, the module side of the module connector may be coupled with an energy storage device, such as a battery module, or the like.

The system connector includes a top surface 140, an opposite bottom surface 142, and side surfaces 144, 146 that extend between and separate the system side and the mating side of a system housing 104. The module connector includes a top surface 240, an opposite bottom surface 242, and side surfaces 244, 246 that extend between and separate the module side and the mating side of a module housing 204. In the illustrated embodiment of FIGS. 1 through 4, the system connector and the module connector have a substantially rectangular cross-sectional shape between the top, bottom, and side surfaces. Alternatively, the system connector and/or the module connector may have any alternative uniform and/or unique shapes and/or sizes relative to each other.

The connector assembly includes three system power contacts 110 that correspond with three module power contacts 210 that may be electrically coupled with each other as contact assemblies while the system connector is coupled with the module connector. For example, the connector assembly may be referred to as a three-phase electrical power assembly.

The connector assembly includes plural system signal contacts 114 that correspond with plural module signal contacts 214. The system signal contacts may be electrically coupled with the module signal contacts to form signal contact assemblies while the system connector is coupled with the module connector. In the illustrated embodiments, the connector assembly includes twelve signal contact assemblies, however the connector assembly may include any number of signal contact assemblies. The signal contact assemblies may be used for communication wiring, or other low voltage wiring.

The connector assembly also includes plural mating and/or alignment features that facilitate the alignment of the system connector to be coupled with the mating module connector. In the illustrated embodiment, the module connector includes plural alignment features 248 that correspond with plural alignment features 148 (shown in FIG. 5) of the system connector. In the illustrated embodiment, the module alignment features are female receptors that are configured to receive male alignment pins as the system alignment features. Alternatively, the alignment features may be any alternative design that enables alignment of the system connector with the module connector along the mating axis. Additionally, the module connector and the system connector include two corresponding alignment features, however the module connector and the system connector may include any number of unique and/or common alignment features, designs, or the like.

Figure 5:
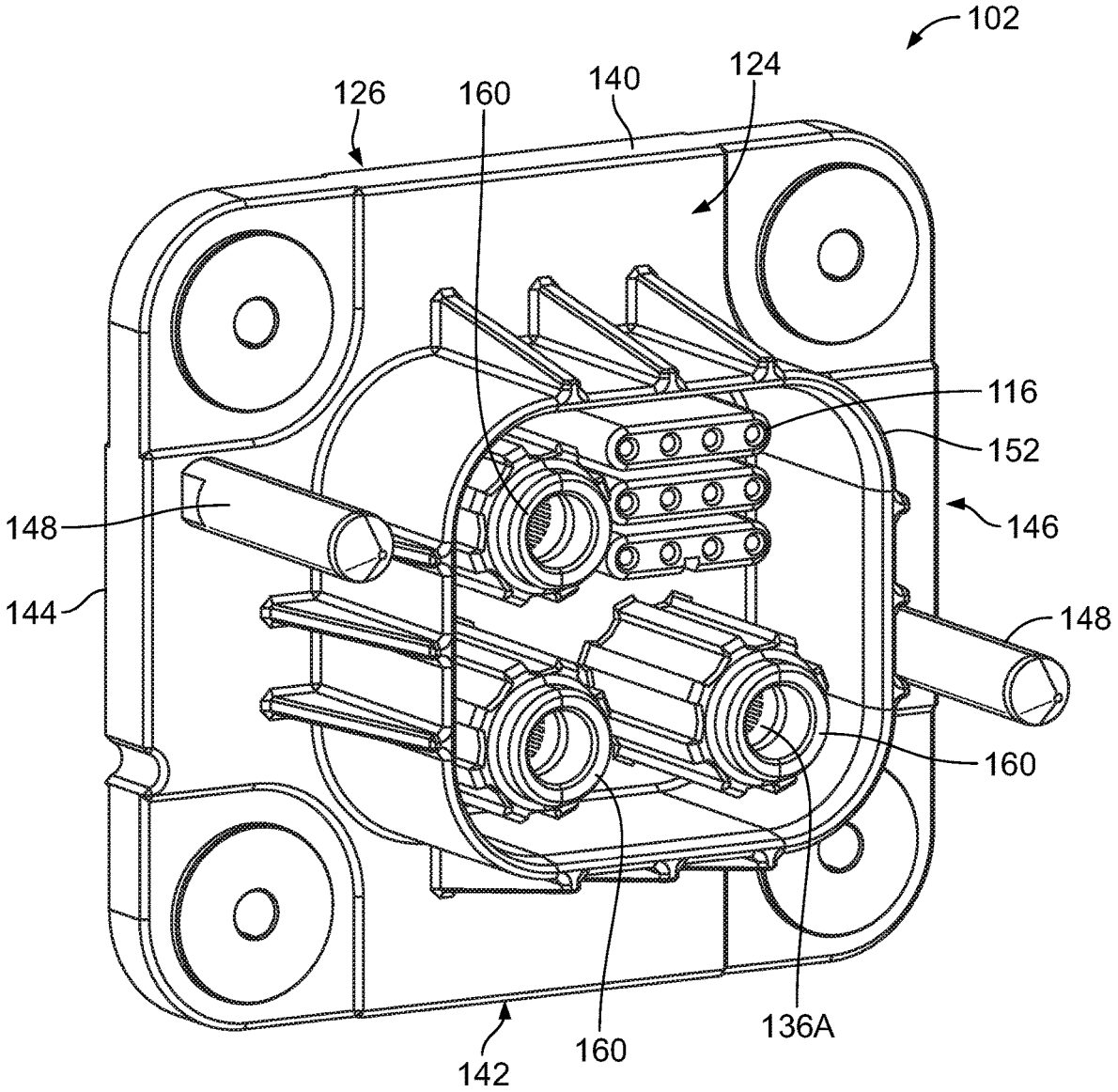
FIG. 5 illustrates a perspective view of a system connector in accordance with one embodiment.
Figure 6:
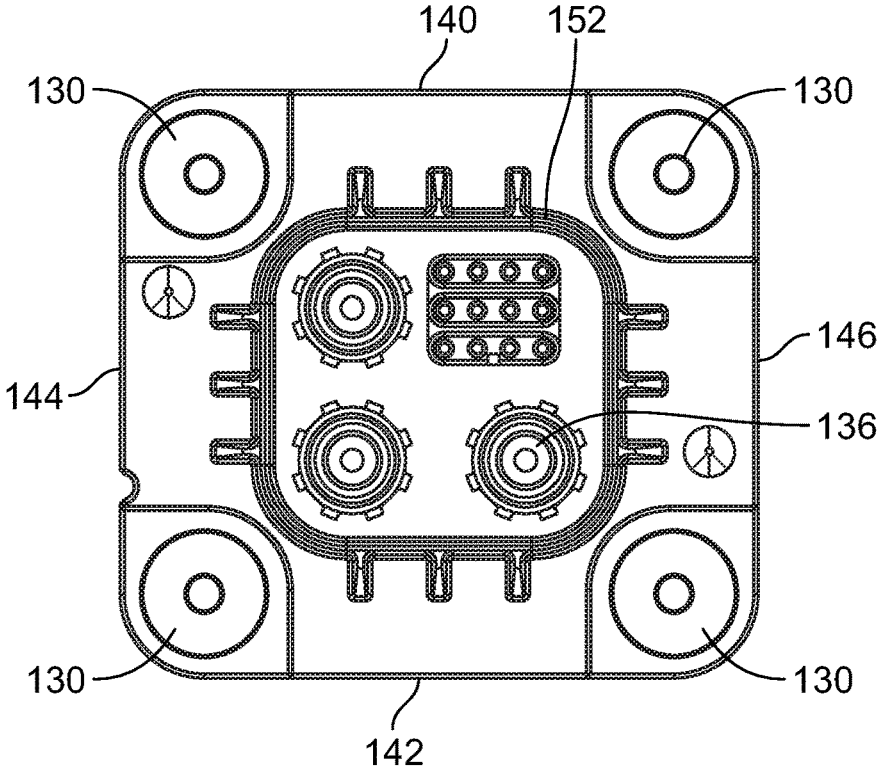
FIG. 6 illustrates a front view of the system connector shown in FIG. 5.
Figure 7:
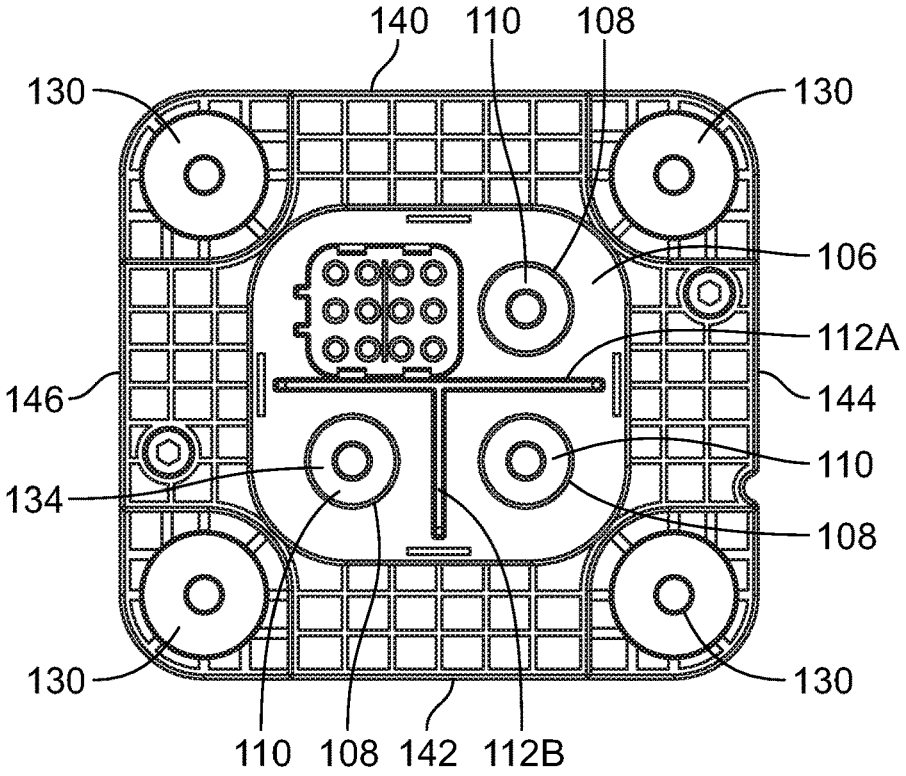
FIG. 7 illustrates a rear view of the system connector shown in FIG. 5.
Figure 8:
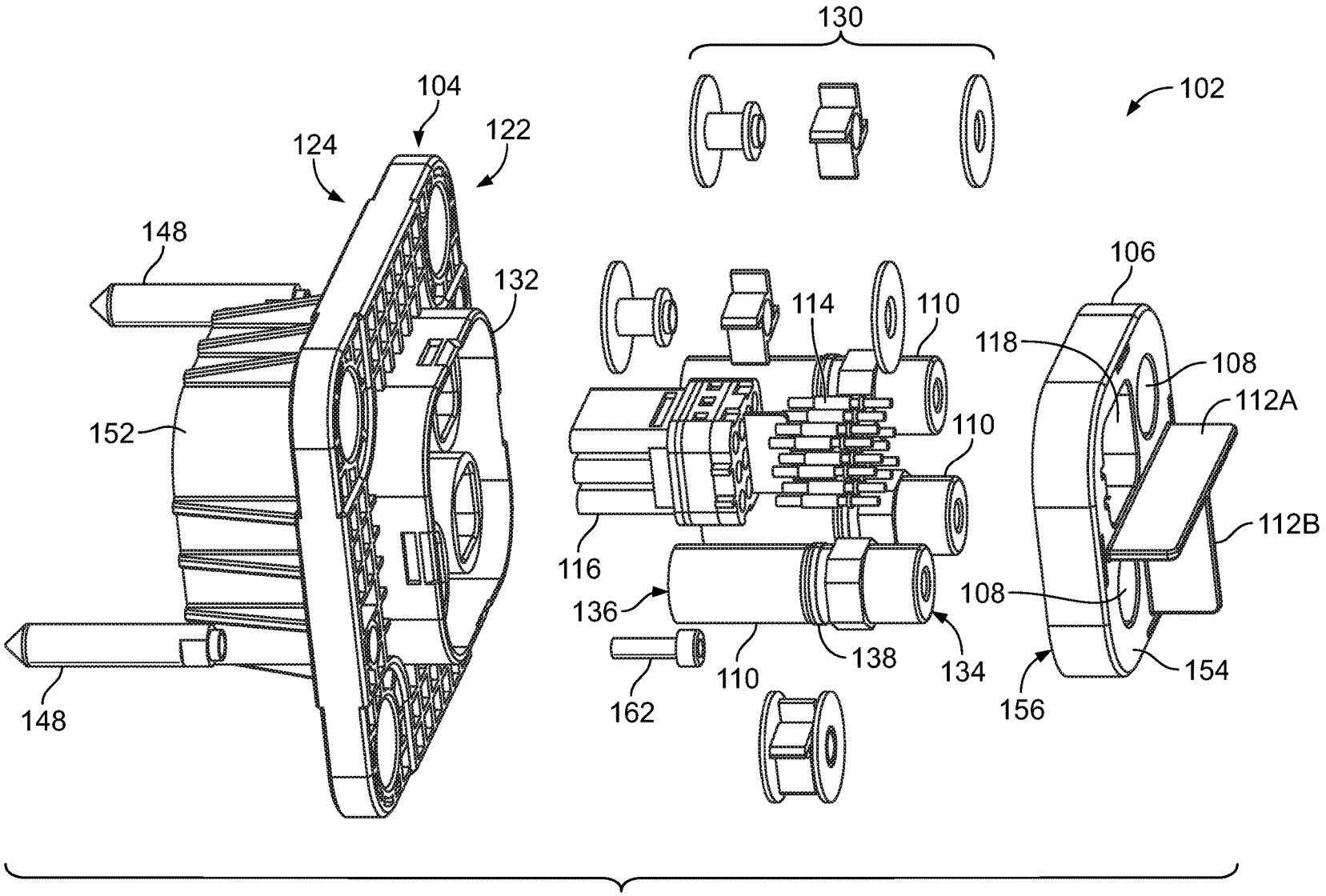
FIG. 8 illustrates an exploded perspective view of the system connector shown in FIG. 5.

FIG. 5 illustrates a perspective view of the system connector in accordance with one embodiment. FIG. 6 illustrates a front view of the system connector, FIG. 7 illustrates a rear view of the system connector, and FIG. 8 illustrates an exploded perspective view of the system connector. FIGS. 5 through 8 will be discussed together herein, and with reference to FIGS. 1 through 4.

The system connector includes the system housing 104 and a system bracket 106. In the illustrated embodiment, the system housing is a separate entity from the system bracket. For example, the system housing may be formed separate from the system bracket. Additionally or alternatively, the system housing and bracket may be formed as a single or unitary entity, such that the housing and the bracket may be molded, additively manufactured, printed, or otherwise formed together.

The system housing may be made of a plastic material, a non-metallic material, or the like. Additionally, the system bracket may be made of a common or different material as the system housing. As one example, the system housing and the system bracket may be made of different non-metallic materials, engineered plastic materials, or the like. In one or more embodiments, the system housing and/or the system bracket may be made of a RoHS compliant material (Restriction of Hazardous Substances), a TSCA compliant material (Toxic Substances Control Act), or the like.

The system bracket includes plural system power contact receptors 108 that receive the system power contacts 110. The bracket also includes a signal pocket 118 that receives a system signal contact housing 116 with the system signal contacts disposed therein. In one or more embodiments, one or more of the system signal contacts may include a gasket that may extend around at least a portion of the perimeter of the system signal contact. The gaskets may be environmental gaskets, electromagnetic shielding gaskets, or a combination therein.

The system bracket includes a first surface 154 and a second surface 156, with the power contact receptors and the signal pocket being openings or passages that extend between the first and second surfaces. For example, a first end 134 of each of the system power contacts is open to and faces the first surface of the system bracket, and a second end 136 of each system power contact extends away from the second surface of the system bracket. Each of the three system power contacts also include gaskets 138 that are coupled with and extend around an exterior perimeter surface of the system power contacts. The gaskets may provide environmental sealing between the first and second ends of the power contacts, may provide electromagnetic sealing, may improve an amount of friction between the system power contacts and the system power contact receptors of the system bracket, or the like.

The system bracket may include extensions 112A, 112B that extend a distance away from the first surface of the bracket. In the illustrated embodiment, the system bracket includes a first extension 112A and a second extension 112B that is substantially perpendicular to the first extension. The first and second extensions may be formed as a unitary embodiment with the system bracket, or alternatively may be separate entities that may be coupled with the first surface of the system bracket. The first and second extensions separate each of the system power contact receptors from each other. Additionally, the extensions separate the system power contact receptors from the system signal contacts disposed within the system signal contact housing. The extensions may extend a distance that is less than 16 mm away from the first surface, that is between about 16 mm and about 20 mm, that is greater than 20 mm, or the like. In one or more embodiments, the first and second extensions may extend common or unique distances away from the first surface. Optionally, the system bracket may include more than two extensions.

The system housing may include a mating feature 152 that is disposed on the mating side of the housing, and a pocket 132 that is disposed on the system side of the housing. Plural openings extend between the mating side and the system side that enable the system power contacts and the system signal contacts to extend between the mating side and the system side. For example, electrical connection made be made on one or both sides of the system housing, the electrical connections may extend through the system housing, or the like.

The mating feature 152 may receive a mating feature 252 of the module housing (illustrated in FIG. 12) when the system and module connectors are coupled. In the illustrated embodiment, the mating feature is a pocket that is an opening disposed on and extending a distance away from the mating side of the system housing. The system housing also includes plural power contact mating features 160 that are disposed within the pocket mating feature. The second ends 136 of each of the system power contacts extend within the power contact mating features.

The system connector may include one or more alignment locks 162 that are received within passages extending between the mating side and the system side of the system housing. The alignment locks may be coupled with the alignment features 148 that are coupled with and extend a distance away from the mating side of the system housing. In the illustrated embodiment, the alignment features are pins that are coupled with the mating side of the system housing and extend a distance away from the system housing. Optionally, in one or more embodiments, the alignment features of the system housing may be molded, printed, or otherwise formed as a unitary structure with the system housing.

The system connector may include one or more floating assemblies 130. The floating assemblies are received within passages extending between the mating and system sides of the system housing. The floating assemblies may mate with one or more mating features of a mating system of the vehicle (not shown). For example, the floating assemblies enable the system connector to float in one or more different directions relative to the mating axis when the system connector is coupled with the module connector allowing the system connector and the module connector to be blindly coupled with the mating system of the vehicle. For example, an operator may couple the module connector with the mating system of the vehicle (not shown) without looking at, having a direct line-of sight, or the like, the connection or coupling features between the system connector and the mating system of the vehicle.

The float assemblies may enable the system housing to float or otherwise move in the X and/or Y directions (e.g., in one or more directions substantially perpendicular to the mating axis 150). Additionally or alternatively, one or more of the coupling features between the system connector and the mating system of the vehicle may be one or more system connector mounting assemblies that may allow the system connector to float in the Z-direction (e.g., substantially parallel to the mating axis 150) while the module connector is being coupled with the system connector.

Figure 13:
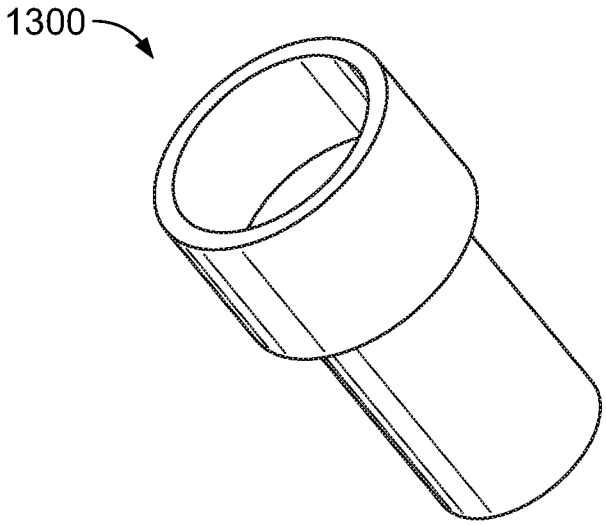
FIG. 13 illustrates a perspective view of a system connector mounting assembly in accordance with one embodiment.
Figure 14:
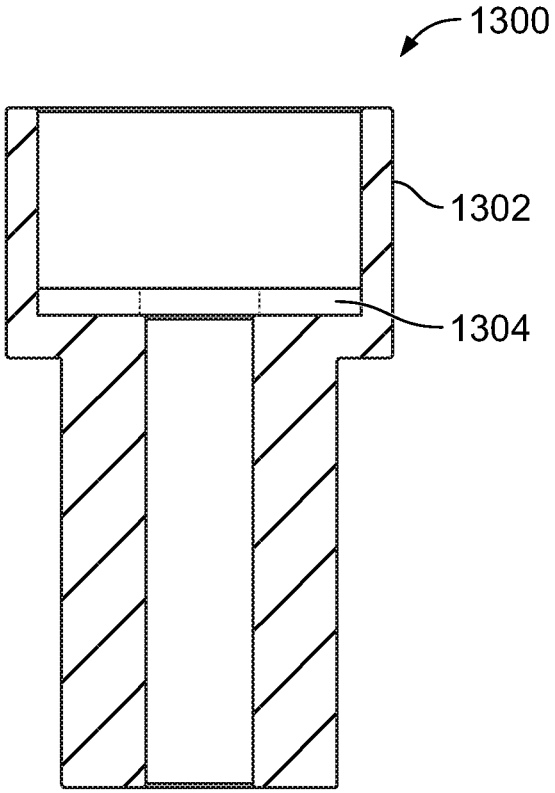
FIG. 14 illustrates a cross-sectional view of the system connector mounting assembly shown in FIG. 13.

As one example, the float assemblies 130 may be coupled with one or more system connector mounting assemblies 1300 illustrated in FIGS. 13 and 14. The system connector mounting assemblies 1300 may include a flexible bushing 1302, such as a rubber bushing, and a washer 1304 that may be molded or otherwise coupled with the flexible bushing. The flexible bushing may be designed to allow enough flexibility to first allow the module connector to be coupled with the system connector, and enough flexibility to subsequently allow the system connector to compress the flexible bushing in order to float in the Z-direction. For example, the system connector mounting assemblies may be designed (e.g., such as with appropriate material properties, size, or the like) to have enough resistance to cause the module and system connectors to mate first, then the remaining flexibility of the flexible bushing allows the system connector to float or otherwise move in the Z direction. The float assemblies and the system connector mounting assemblies may allow the system connector to float or move in at least two different directions less than 1 millimeter (mm), between about 1 mm and about 5 mm, between about 1 mm and about 10 mm, or the like. In one or more embodiments, the float assemblies may allow the system connector to move or float at least 4 mm in two or more different directions relative to a position of the mating system of the vehicle.

Figure 9:
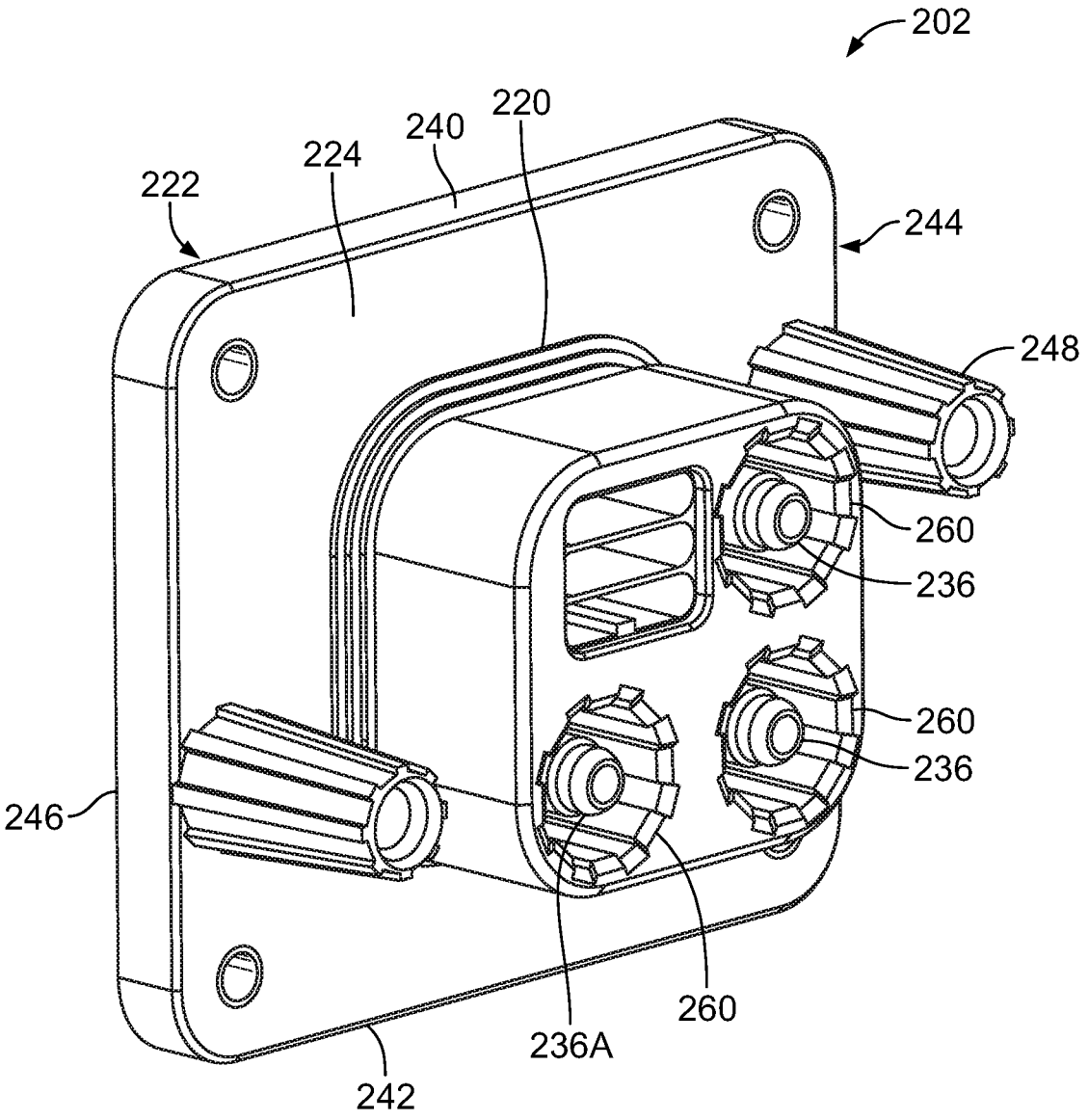
FIG. 9 illustrates a perspective view of a module connector in accordance with one embodiment.
Figure 10:
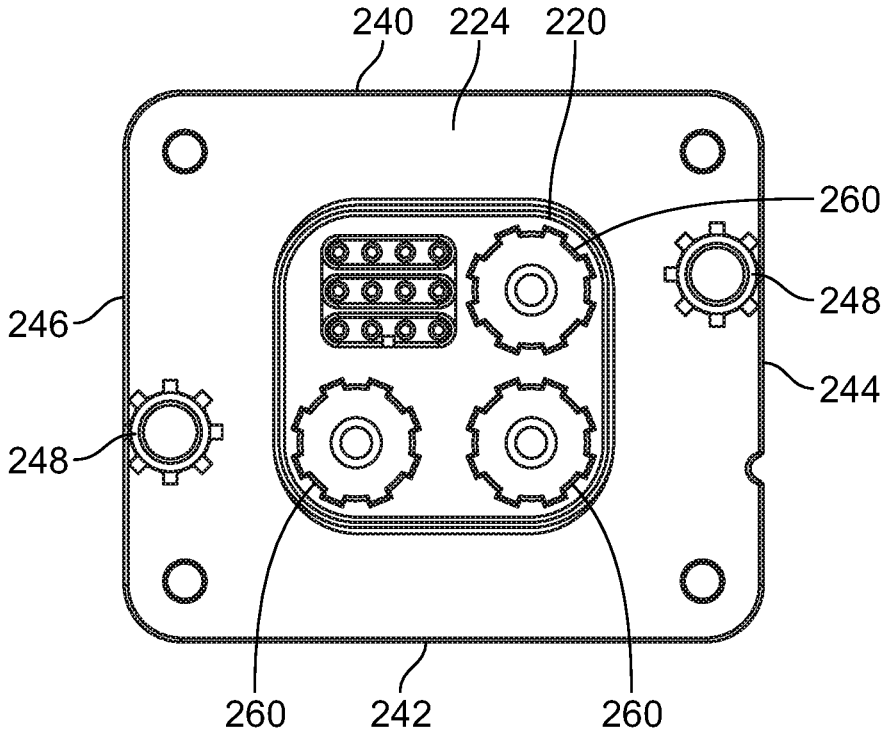
FIG. 10 illustrates a front view of the module connector shown in FIG. 9.
Figure 11:
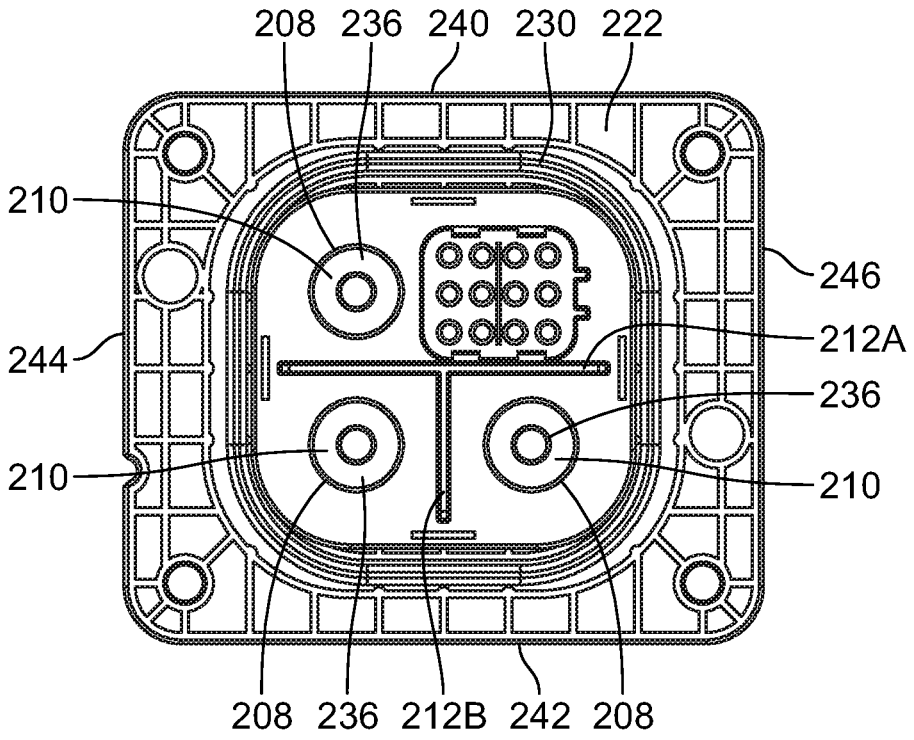
FIG. 11 illustrates a rear view of the module connector shown in FIG. 9.
Figure 12:
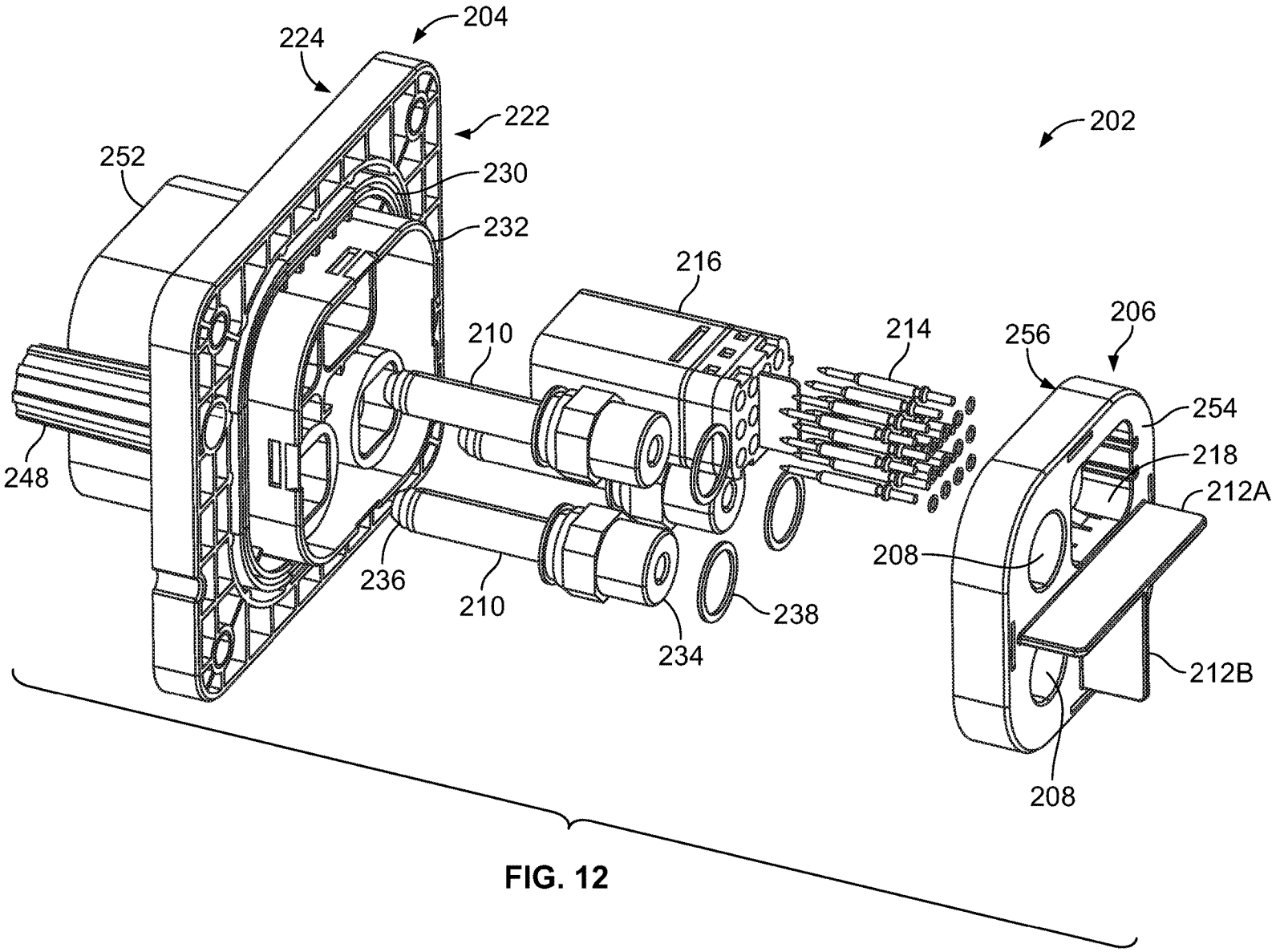
FIG. 12 illustrates an exploded perspective view of the module connector shown in FIG. 9.

FIG. 9 illustrates a perspective view of the module connector 202, FIG. 10 illustrates a front view of the module connector, FIG. 11 illustrates a rear view of the module connector, and FIG. 12 illustrates an exploded perspective view of the module connector. FIGS. 9 through 12 will be discussed together herein, and with reference to FIGS. 1 through 4.

The module connector includes a module housing 204 and a module bracket 206. In the illustrated embodiment, the module housing is a separate entity from the module bracket. Optionally, the module housing and module bracket may be formed as a single or unitary entity or structure, such that the housing and the bracket may be molded, additively manufactured, printed, or otherwise formed together.

The module housing may be made of a plastic material, a non-metallic material, or the like. Additionally, the module bracket may be made of a common or different material as the module housing. As one example, the module housing and the module bracket may be made of different non-metallic materials, engineered plastic materials, or the like.

The module bracket includes plural module power contact receptors 208 that receive the module power contacts 210. The bracket also includes a signal pocket 218 that receives a module signal contact housing 216 with the module signal contacts disposed therein. In one or more embodiments, one or more of the module signal contacts may include a gasket that may extend around at least a portion of the perimeter of the module signal contact. The gaskets may be environmental gaskets, electromagnetic shielding gaskets, or a combination therein.

The module bracket includes a first surface 254 and a second surface 256, with the power contact receptors and the signal pocket being openings or passages that extend between the first and second surfaces. For example, a first end 234 of each of the module power contacts is open to and faces the first surface of the module bracket, and a second end 236 of each module power contact extends away from the second surface of the module bracket. Each of the three module power contacts include gaskets 238 that are coupled with and extend around at least a portion of an exterior perimeter surface of the module power contacts. The gaskets may provide environmental sealing between the first and second ends of the module power contacts, may provide electromagnetic sealing, may improve an amount of friction between the module power contacts and the module power contact receptors of the module bracket, or the like.

In the illustrated embodiment, the second end 236 of each module power contact includes a touch-resistant contact. For example, a non-metallic component may be coupled with or disposed on the second ends of the module power contacts. The touch-resistant contact may allow a user or operator of the connector assembly to touch or make contact with the second ends of the module power contacts without electrically shorting, electrically coupling, or the like, with the module power contacts. As one example, the touch-resistant contacts at the second ends of the module power contacts allows an operator or user to safely touch the module connector while being protected from the electrical power contacts. Additionally or alternatively, the second ends of one or more of the module power contacts may be recessed to a position within a mating feature 252 of the module housing. As one example, the connector assembly may have an IP2X rating, or the like.

The module bracket may include extensions 212A, 212B that extend a distance away from the first surface of the bracket. In the illustrated embodiment, the system bracket includes a first extension 212A and a second extension 212B that is substantially perpendicular to the first extension. The first and second extensions may be formed as a unitary embodiment with the system bracket, or alternatively may be separate entities that may be coupled with the first surface of the module bracket. The first and second extensions separate each of the module power contact receptors from each other. The extensions may extend a distance that is less than about 16 mm away from the first surface, a distance that is between about 16 mm and about 20 mm, a distance that is greater than about 20 mm, or the like. In one or more embodiments, the first and second extensions may extend common or unique distances away from the first surface. Optionally, the module bracket may include more than two extensions.

The module housing may also include a mating feature 252 that is disposed on the mating side of the housing, and a pocket 232 that is disposed on the module side of the housing. Plural openings extend between the mating side and the module side that enable the module power contacts and the module signal contacts to extend between the mating side and the module side.

The mating feature may receive the mating feature 152 of the system housing when the system and module connectors are assembled. The mating feature of the module housing is a block or a plug that is shaped and sized to be received within the female pocket of the mating feature of the system housing. Additionally, the mating feature includes plural power contact mating features 260 that correspond with the plural contact mating features 160 of the system housing. The second ends 236 of each of the module power contacts extend within the power contact mating features.

The module housing includes the alignment features 248 that are configured to receive the alignment features 148 of the system housing when the system and module connectors are assembled. The alignment features 248 of the module housing are formed or molded together with the module housing, are disposed on the mating side of the module housing, and extend a distance away from the module housing. In one or more embodiments, the alignment features may extend a distance away from the mating side that is about the same or different than the distance away the mating feature 252 extends from the mating side of the module housing.

The module connector may also include a gasket 220 that is disposed on the mating side of the module housing and extends around at least a portion of a perimeter of the mating feature. Additionally or alternatively, a gasket 230 may be disposed on the module side of the module housing and extend around at least a portion of a perimeter of the pocket 232. The gaskets 220, 230 may be made of the same and/or different materials. For example, the gaskets 220, 230 may be made of a non-conductive elastomeric material, a conductive elastic material, a thermoplastic material, or the like. The gasket 220 may be an environmental seal, an electromagnetic seal, or the like, between the module housing coupled with the system housing. The gasket 230 may be an environmental seal and/or an electromagnetic seal between the module housing and an energy storage module (e.g., a battery module, a battery module system, or the like). In one or more embodiments, the gaskets 220, 230 coupled with the module connector provides an IP67 rating for the connector assembly. Optionally, the connector assembly may include one or more additional gaskets coupled with the system connector and/or the module connector that may change and/or improve the IP rating of the connector assembly.

Returning to FIGS. 1 through 4, the module connector 202 is assembled with the system connector 102 to form the connector assembly 100. For example, the connectors are positioned such that the mating sides 124, 224 are facing each other, that the alignment features 148 of the system connector are aligned with the alignment features 248 of the module connector. Additionally, the mating feature 252 of the module housing is aligned with the mating feature 152 (e.g., the receiving pocket) of the system housing. The module connector and the system connector are moved towards each other along the mating axis to form the connector assembly 100.

While the system connector is coupled with the module connector, each of the signal contacts of the module connector are electrically coupled with each respective signal contact of the system connector to form the plural signal contact assemblies. Each of the signal contact assemblies may have an operating voltage of at least 25 volts, at least 50 volts, at least 75 volts, or the like.

Different aspects of the connector assembly, such as, but limited to, the materials, conductivity, thicknesses, dielectric constants, and/or spacing of the components of the connector assembly may be selected with reference to a target voltage, current, duty temperature, or the like, of the connector assembly. For example, while the system connector is coupled with the module connector, each system power contact 110 is coupled with each corresponding module power contact 210 to form plural contact assemblies. The position and size of the extensions 112A, 112B, 212A, 212B of the system and module brackets, respectively, enables the power contact assemblies to operate at an operating voltage that is at least 2000 volts without the power contact assemblies electrically interfering with each other, For example, at least two of the power contact assemblies may be separated from each other power contact assembly by a distance that is less than about 10 mm, that is between about 10 mm and about 20 mm, that is between about 10 mm and about 30 mm, or the like. In one embodiment, at least two power contact assemblies may be separate from each other by about 20 mm. In a preferred embodiment, at least two power contact assemblies may be separate from each other by about 15 mm. In a more preferred embodiment, at least two power contact assemblies may be separate from each other by about 10 mm. Additionally, at least two of the power contact assemblies may be separated from each other by no more than 15 mm. Disposing the extensions between the power contact assemblies allows the power contact assemblies to be positioned closer to each other power contact assembly relative to the system and module brackets not including the extensions. For example, without the extensions disposed between the system and module power contacts, respectively, the power contact assemblies may need to be separated from each other by a distance that is greater than 40 mm while still being able to operate at a 2000 volt operating voltage.

Additionally, the extensions separate the power contact assemblies from the signal contact assemblies, thereby isolating the voltage between the signal and power contacts of the connector assembly. For example, the signal contact assemblies may be separated from at least one of power contact assemblies by a distance that is less than about 8 mm, that is between about 8 mm and about 10 mm, that is between about 8 mm and about 20 mm, that is between about 8 mm and about 30 mm, or the like. In one embodiment, the signal contact assemblies may be separate from at least one of the power contact assemblies by about 15 mm. In a preferred embodiment, the signal contact assemblies may be separate from at least one of the power contact assemblies by a distance that is about 10 mm. In a more preferred embodiment, the signal contact assemblies may be separate from at least one of the power contact assemblies by a distance that is about 8 mm. Disposing the extensions between the signal contact assemblies and the power contact assemblies allows the signal contact assemblies to be positioned closer to the power contact assemblies relative to the system and module brackets not including the extensions. For example, without the extensions disposed between the power contact assemblies and the signal contact assemblies, the signal contact assemblies may need to be separated from each of the power contact assemblies by a distance that is greater than 35 mm while still being able to operate at a 2000 volts operating voltage.

Additionally, the module and system power contacts may be sized to have and/or meet a specific current rating. For example, at least one of the plural power contact assemblies may be sized in order to have a current rating that is at least 225 amperes. For example, the power contact assemblies may have a 2000 volt creep and clearance rating and may be rated for 225 amperes/2000 volts power cables.

In one or more embodiments, at least one of the module power contacts may be longer than the other module power contacts, such that the longer module power contact extends a distance further away from the mating side of the module housing. The longer module power contact may be the first to mate or electrically couple with the corresponding system power contact when the system connector is coupled with the module connector. For example, the longer module power contact may be a first to mate and last to break to improve the grounding safety of the connector assembly.

The connector assembly including the module connector coupled with the system connector may have an assembled volume that is less than or including 2,000 cubic centimeters as defined by outer edges of the system housing and the module housing. For example, the connector assembly may extend from the extensions 212A, 212B of the module housing to the extensions 112A, 112B of the system housing in a first direction, may extend from top surfaces 140, 240 to bottom surfaces 142, 242 of the system and module housings in a second direction, and may extend from first sides 144, 244 to second sides 146, 246 of the system and module housings in a third direction. Optionally, the connector assembly may have a volume that is greater than 2,000 cubic centimeters.

In one or more embodiments of the subject matter described herein, a connector assembly includes a system connector having a system housing and a system bracket coupled with the system housing. The system bracket includes plural system power contact receptors that receive plural system power contacts. The plural system power contacts are separate from each other by one or more extensions coupled with the system bracket. A module connector is coupled with the system connector. The module connector includes a module housing and a module bracket coupled with the module housing. The module bracket includes plural module power contact receptors that receive plural module power contacts. Each of the plural module power contacts are separated from each other by one or more extensions coupled with the module bracket. Each of the plural system power contacts of the system bracket are configured to mate with one of the plural module power contacts of the module bracket as plural power contact assemblies.

Optionally, each of the plural power contact assemblies may have an operating voltage of at least 2000 volts.

Optionally, at least one of the plural power contact assemblies has a current rating of at least 225 amperes.

Optionally, two or more of the plural power contact assemblies are separated from each other by a distance that is no more than 15 mm.

Optionally, the module connector coupled with the system connector electrically couples a first battery module of a battery system with a plurality of additional battery modules of the battery system.

Optionally, the module connector coupled with the system connector may electrically couple an energy storage device of a vehicle with one or more of a propulsion system of the vehicle or an energy storage system of the vehicle.

Optionally, a rail vehicle may include the connector assembly, a chassis and plural wheels coupled to the chassis. The energy storage device, the propulsion system, and the energy storage system may be attached to the chassis. The module connector coupled with the system connector electrically couples the energy storage device with one or more of the propulsion system or the energy storage system. The plural wheels coupled to the chassis and the propulsion system are configured to be driven by the propulsion system to move the rail vehicle along a track.

Optionally, the system connector may include one or more system signal contacts disposed within a system signal contact housing. The system signal contact housing may be retained within a signal pocket of the system bracket.

Optionally, the module connector may include one or more module signal contacts disposed within a module signal contact housing. The module signal contact housing may be retained within a signal pocket of the module bracket.

Optionally, each of the module signal contacts of the module connector may be electrically coupled with one of plural system signal contacts of the system connector to form plural signal contact assemblies. One or more of the plural signal contact assemblies may have an operating voltage of at least 75 volts.

Optionally, the connector assembly may include one or more gaskets disposed within one or more of the system housing or the module housing.

Optionally, the module connector coupled with the system connector may have an assembled volume that is no more than 2,000 cubic centimeters defined by outer edges of the system housing and the module housing.

Optionally, the system housing may mate with a mating system of a vehicle via one or more float assemblies. The one or more float assemblies may allow the system connector to float at least 4 mm in two or more directions relative to a position of the mating system of the vehicle.

In one or more embodiments of the subject matter described herein, a connector assembly includes a system connector having a system housing and a system bracket coupled with the system housing. The system bracket includes plural system power contact receptors that receive plural system power contacts. The plural system power contacts are separate from each other by one or more extensions coupled with the system bracket. The system connector includes one or more system signal contacts disposed within a system signal contact housing. The system signal contact housing is retained within a pocket of the system bracket. A module connector is coupled with the system connector. The module connector includes a module housing and a module bracket coupled with the module housing. The module bracket includes plural module power contact receptors that receive plural module power contacts. Each of the plural module power contacts are separated from each other by one or more extensions coupled with the module bracket. The module connector includes one or more module signal contacts disposed within a module signal contact housing. The module signal contact housing is retained within a signal pocket of the module bracket. Each of the plural system power contacts of the system bracket are configured to mate with one of the plural module power contacts of the module bracket as plural power contact assemblies. Each of the module signal contacts of the module connector are electrically coupled with one of the one or more system signal contacts of the system connector to form plural signal contact assemblies.

Optionally, each of the plural power contact assemblies may have an operating voltage of at least 2000 volts and a current rating of at least 225 amperes.

Optionally, one or more of the signal contact assemblies may have an operating voltage of at least 75 volts.

Optionally, two or more of the plural power contact assemblies may be separated from each other by a distance that is no more than 15 mm.

Optionally, at least one of the plural power contact assemblies may be separated from the plural signal contact assemblies by a distance that is no more than 8 mm.

Optionally, the module connector coupled with the system connector may electrically couple an energy storage device of a vehicle with one or more of a propulsion system of the vehicle or an energy storage system of the vehicle.

In one or more embodiments of the subject matter described herein, a connector assembly includes a system connector having a system housing and a system bracket coupled with the system housing. The system bracket includes plural system power contact receptors that receive plural system power contacts. The plural system power contacts are separate from each other by one or more extensions coupled with the system bracket. The system connector includes one or more system signal contacts disposed within a system signal contact housing. The system signal contact housing is retained within a pocket of the system bracket. A module connector is coupled with the system connector. The module connector includes a module housing and a module bracket coupled with the module housing. The module bracket includes plural module power contact receptors that receive plural module power contacts.

Each of the plural module power contacts are separated from each other by one or more extensions coupled with the module bracket. The module connector includes one or more module signal contacts disposed within a module signal contact housing. The module signal contact housing is retained within a signal pocket of the module bracket. Each of the plural system power contacts of the system bracket are configured to mate with one of the plural module power contacts of the module bracket as plural power contact assemblies. Each of the plural power contact assemblies has an operating voltage of at least 2000 volts and a current rating of at least 225 amperes. Each of the module signal contacts of the module connector are electrically coupled with one of the one or more system signal contacts of the system connector to form plural signal contact assemblies. One or more of the plural signal contact assemblies has an operating voltage of at least 75 volts.

As used herein, the terms "processor" and "computer," and related terms, e.g., "processing device," "computing device," and "controller" may be not limited to just those integrated circuits referred to in the art as a computer, but refer to a microcontroller, a microcomputer, a programmable logic controller (PLC), field programmable gate array, and application specific integrated circuit, and other programmable circuits. Suitable memory may include, for example, a computer-readable medium. A computer-readable medium may be, for example, a random-access memory (RAM), a computer-readable non-volatile medium, such as a flash memory. The term "non-transitory computer-readable media" represents a tangible computer-based device implemented for short-term and long-term storage of information, such as, computer-readable instructions, data structures, program modules and sub-modules, or other data in any device. Therefore, the methods described herein may be encoded as executable instructions embodied in a tangible, non-transitory, computer-readable medium, including, without limitation, a storage device and/or a memory device. Such instructions, when executed by a processor, cause the processor to perform at least a portion of the methods described herein. As such, the term includes tangible, computer-readable media, including, without limitation, non-transitory computer storage devices, including without limitation, volatile and non-volatile media, and removable and non-removable media such as firmware, physical and virtual storage, CD-ROMS, DVDs, and other digital sources, such as a network or the Internet.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A connector assembly comprising:

a system connector comprising a system housing and a system bracket coupled with the system housing, the system bracket having plural system power contact receptors configured to receive plural system power contacts, wherein the plural system power contacts are separated from each other by one or more extensions coupled with the system bracket; and a module connector coupled with the system connector, the module connector comprising a module housing and a module bracket coupled with the module housing, the module bracket having plural module power contact receptors configured to receive plural module power contacts, wherein each of the plural module power contacts are separated from each other by one or more extensions coupled with the module bracket, wherein each of the plural system power contacts of the system bracket are configured to mate with one of the plural module power contacts of the module bracket as plural power contact assemblies.

2. The connector assembly of claim 1, wherein each of the plural power contact assemblies is configured to have an operating voltage of at least 2000 volts.

3. The connector assembly of claim 1, wherein at least one of the plural power contact assemblies is configured to have a current rating of at least 225 amperes.

4. The connector assembly of claim 1, wherein two or more of the plural power contact assemblies are separated from each other by a distance that is no more than 15 mm.

5. The connector assembly of claim 1, wherein the module connector coupled with the system connector is configured to electrically couple a first battery module of a battery system with a plurality of additional battery modules of the battery system.

6. The connector assembly of claim 1, wherein the module connector coupled with the system connector is configured to electrically couple an energy storage device of a vehicle with one or more of a propulsion system of the vehicle or an energy storage system of the vehicle.

7. A rail vehicle comprising:

the connector of claim 6;

a chassis, and the energy storage device, the propulsion system, and the energy storage system attached to the chassis, wherein the module connector coupled with the system connector electrically couples the energy storage device with one or more of the propulsion system or the energy storage system; and plural wheels coupled to the chassis and the propulsion system, the plural wheels configured to be driven by the propulsion system to move the rail vehicle along a track.

8. The connector assembly of claim 1, the system connector further comprising one or more system signal contacts disposed within a system signal contact housing, the system signal contact housing configured to be retained within a signal pocket of the system bracket.

9. The connector assembly of claim 1, the module connector further comprising one or more module signal contacts disposed within a module signal contact housing, the module signal contact housing configured to be retained with a signal pocket of the module bracket.

10. The connector assembly of claim 9, wherein each of the module signal contacts of the module connector are configured to be electrically coupled with one of plural system signal contacts of the system connector to form plural signal contact assemblies, wherein one or more of the plural signal contact assemblies are configured to have an operating voltage of at least 75 volts.

11. The connector assembly of claim 1, further comprising one or more gaskets disposed within one or more of the system housing or the module housing.

12. The connector assembly of claim 1, wherein the module connector coupled with the system connector has an assembled volume that is no more than 2,000 cubic centimeters defined by outer edges of the system housing and the module housing.

13. The connector assembly of claim 1, wherein the system housing is configured to mate with a mating system of a vehicle via one or more float assemblies, wherein the one or more float assemblies are configured to allow the system connector to float at least 4 mm in two or more directions relative to a position of the mating system of the vehicle.

14. A connector assembly comprising:

a system connector comprising a system housing and a system bracket coupled with the system housing, the system bracket having plural system power contact receptors configured to receive plural system power contacts, wherein the plural system power contacts are separated from each other by one or more extensions coupled with the system bracket, the system connector comprising one or more system signal contacts disposed within a system signal contact housing, the system signal contact housing configured to be retained within a signal pocket of the system bracket;

a module connector coupled with the system connector, the module connector comprising a module housing and a module bracket coupled with the module housing, the module bracket having plural module power contact receptors configured to receive plural module power contacts, wherein each of the plural module power contacts are separated from each other by one or more extensions coupled with the module bracket, the module connector comprising one or more module signal contacts disposed within a module signal contact housing, the module signal contact housing configured to be retained within a signal pocket of the module bracket, wherein each of the plural system power contacts of the system bracket are configured to mate with one of the plural module power contacts of the module bracket as plural power contact assemblies, and wherein each of the one or more module signal contacts of the module connector are configured to be electrically coupled with one of the one or more system signal contacts of the system connector to form plural signal contact assemblies.

15. The connector assembly of claim 14, wherein each of the plural power contact assemblies is configured to have an operating voltage of at least 2000 volts and a current rating of at least 225 amperes.

16. The connector assembly of claim 14, wherein one or more of the plural signal contact assemblies are configured to have an operating voltage of at least 75 volts.

17. The connector assembly of claim 14, wherein two or more of the plural power contact assemblies are separated from each other by a distance that is no more than 15 mm.

18. The connector assembly of claim 14, wherein at least one of the plural power contact assemblies is separated from the plural signal contact assemblies by a distance that is no more than 8 mm.

19. The connector assembly of claim 14, wherein the module connector coupled with the system connector is configured to electrically couple an energy storage device of a vehicle with one or more of a propulsion system of the vehicle or an energy storage system of the vehicle.

20. A connector assembly comprising:

a system connector comprising a system housing and a system bracket coupled with the system housing, the system bracket having plural system power contact receptors configured to receive plural system power contacts, wherein the plural system power contacts are separated from each other by one or more extensions coupled with the system bracket, the system connector comprising one or more system signal contacts disposed within a system signal contact housing, the system signal contact housing configured to be retained within a signal pocket of the system bracket;

a module connector coupled with the system connector, the module connector comprising a module housing and a module bracket coupled with the module housing, the module bracket having plural module power contact receptors configured to receive plural module power contacts, wherein each of the plural module power contacts are separated from each other by one or more extensions coupled with the module bracket, the module connector comprising one or more module signal contacts disposed within a module signal contact housing, the module signal contact housing configured to be retained within a signal pocket of the module bracket, wherein each of the plural system power contacts of the system bracket are configured to mate with one of the plural module power contacts of the module bracket as plural power contact assemblies, wherein each of the plural power contact assemblies is configured to have an operating voltage of at least 2000 volts and a current rating of at least 225 amperes, and wherein each of the one or more module signal contacts of the module connector are configured to be electrically coupled with one of the one or more system signal contacts of the system connector to form plural signal contact assemblies, wherein one or more of the plural signal contact assemblies are configured to have an operating voltage of at least 75 volts.

* * * * *